US008979026B2

(12) United States Patent
Dorman et al.

(10) Patent No.: US 8,979,026 B2
(45) Date of Patent: Mar. 17, 2015

(54) AIR COMPRESSOR BACKING PLATE

(71) Applicant: Hamilton Sundstrand Corporation, Windsor Locks, CT (US)

(72) Inventors: David A. Dorman, Feeding Hills, MA (US); Harold W. Hipsky, Willington, CT (US); Peter A. Wierzbowski, Old Saybrook, CT (US); Eric Chrabascz, Longmeadow, MA (US); Brian Cabello, Windsor, CT (US)

(73) Assignee: Hamilton Sundstrandt Corporation, Windsor Locks, CT (US)

( * ) Notice: Subject to any disclaimer, the term of this patent is extended or adjusted under 35 U.S.C. 154(b) by 37 days.

(21) Appl. No.: 13/909,377

(22) Filed: Jun. 4, 2013

(65) Prior Publication Data

US 2014/0356124 A1 Dec. 4, 2014

(51) Int. Cl.
*B64D 11/00* (2006.01)
*F01D 9/04* (2006.01)

(52) U.S. Cl.
CPC ..... *F01D 9/04* (2013.01)
USPC ..... 244/118.5; 415/204; 415/206

(58) Field of Classification Search
USPC ..... 244/118.5
See application file for complete search history.

(56) References Cited

U.S. PATENT DOCUMENTS

| | | | | |
|---|---|---|---|---|
| 3,644,055 | A | 2/1972 | Davis | |
| 3,808,833 | A * | 5/1974 | Allen et al. | 62/467 |
| 4,801,250 | A * | 1/1989 | Lammers | 417/265 |
| 5,020,973 | A * | 6/1991 | Lammers | 417/243 |
| 7,125,221 | B2 * | 10/2006 | Dorsch et al. | 415/121.1 |
| 7,563,074 | B2 * | 7/2009 | Xu | 416/185 |
| 7,871,243 | B2 * | 1/2011 | Chen et al. | 415/149.1 |
| 8,231,342 | B2 * | 7/2012 | Lacey et al. | 415/198.1 |
| 2002/0119044 | A1 * | 8/2002 | O'Connor et al. | 415/204 |
| 2002/0146319 | A1 * | 10/2002 | Dorsch et al. | 415/206 |
| 2005/0196272 | A1 * | 9/2005 | Nikpour | 415/206 |
| 2006/0059927 | A1 * | 3/2006 | Zywiak et al. | 62/172 |
| 2006/0251808 | A1 * | 11/2006 | Kamo et al. | 427/230 |
| 2008/0232959 | A1 * | 9/2008 | Nikpour | 415/206 |
| 2008/0279682 | A1 * | 11/2008 | Wydra | 415/206 |
| 2010/0322762 | A1 * | 12/2010 | Shirahama et al. | 415/204 |

FOREIGN PATENT DOCUMENTS

WO 2005035993 A1 4/2005

OTHER PUBLICATIONS

European Search Report for Application No. 14170804.0-1607, Mailed on Sep. 26, 2014, 7 pages.

* cited by examiner

*Primary Examiner* — Christopher P Ellis
*Assistant Examiner* — Medhat Badawi
(74) *Attorney, Agent, or Firm* — Cantor Colburn LLP

(57) ABSTRACT

A compressor for pressurizing a flow of air within an aircraft including an inlet providing the flow of air to the compressor. An outlet provides the flow of air, after pressurization by the compressor, to a chamber of the aircraft. A diffuser assembly is disposed between the inlet and the outlet. The diffuser assembly includes one or more vanes at least partially impeding the flow of air through the diffuser assembly. A backing plate is included having a surface adjacent to the one or more vanes. The surface includes a relief feature that enables air to bypass the one or more vanes. The relief feature has an axial depth of about 0.5% to 2.5% of a width of a flow path through the diffuser assembly or of about 0.5% to 5% of a thickness of a flange of the backing plate. A method of operating a compressor is also included.

11 Claims, 2 Drawing Sheets

AIR COMPRESSOR BACKING PLATE

BACKGROUND OF THE INVENTION

The subject matter disclosed herein relates to air compressors and, in particular, to a backing plate for a cabin air compressor in an aircraft.

Current commercial aircraft are routinely equipped with a variety of systems for controlling the temperature, pressure, and other parameters and conditions within the aircraft. For example, an environmental control system (ECS) of the aircraft may include an air compressor, e.g., a cabin air compressor, in order to maintain desired cabin pressure. An air compressor or other component may experience degradation in effectiveness, efficiency, lifespan, or other operating characteristics if operated outside of a preferred range of operating conditions such as may occur in aircraft that are subjected to a wide variety of conditions (e.g., vastly different pressures and temperatures at ground level and cruising altitude).

SUMMARY

According to one embodiment, a compressor for pressurizing a flow of air within an aircraft is disclosed. The compressor includes an inlet providing the flow of air to the compressor. An outlet provides the flow of air, after pressurization by the compressor, to a chamber of the aircraft. A diffuser assembly is disposed between the inlet and the outlet. The diffuser assembly includes one or more vanes at least partially impeding the flow of air through the diffuser assembly. A backing plate is included having a surface adjacent to the one or more vanes. The surface includes a relief feature that enables air to bypass the one or more vanes.

According to another embodiment, a method of operating a compressor in an aircraft is disclosed. The method includes pressurizing air with the compressor as the air travels from an inlet to an outlet and through a diffuser assembly disposed between the inlet and the outlet. Pressurized air is provided to a chamber of the aircraft via the outlet. A portion of air bypasses the one or more vanes of the diffuser assembly via a relief feature formed in a surface of a backing plate of the diffuser assembly adjacent to the one or more vanes.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

A detailed description of one or more embodiments of the disclosed apparatus and method are presented herein with reference to the Figures by way of exemplification and not limitation.

Figure 1:
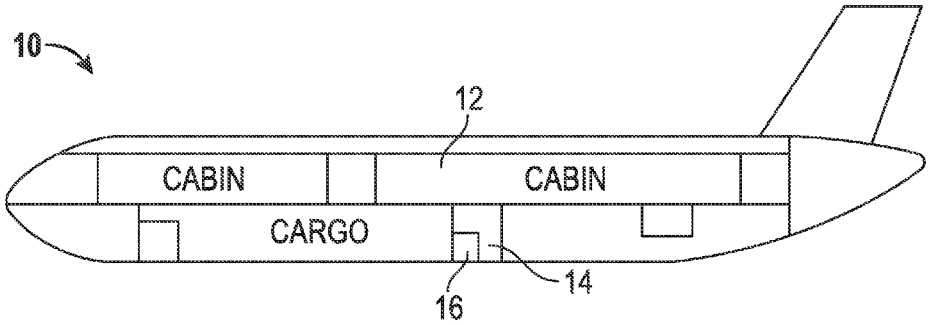
FIG. 1 schematically illustrates an aircraft having an environmental control system.

FIG. 1 schematically illustrates an aircraft 10. The aircraft 10 has various chambers, including a cabin 12, in which conditions related to the environment of the chamber, such as temperature, pressure, etc. are controlled. Other chambers may include or be defined by a galley, cargo area, etc. In the illustrated embodiment, an ECS 14 is included to control the environment (e.g., temperature, pressure, etc.) of the cabin 12 and/or other chambers of the aircraft. The ECS 14 can be arranged to receive, monitor, and/or condition ram air, ambient outside air, air recycled from the cabin 12 or other chambers of the aircraft 10, bleed air from turbines or other components of the aircraft 10, etc., or a combination thereof. In the illustrated embodiment, the ECS 14 includes an air compressor 16 for assisting in the maintenance of a desired air pressure within the cabin 12, i.e., cabin pressure. In this way, the air compressor 16 may be referred to as a cabin air compressor (CAC), although it is to be understood that other compressors may benefit from the embodiments disclosed herein.

Figure 2:
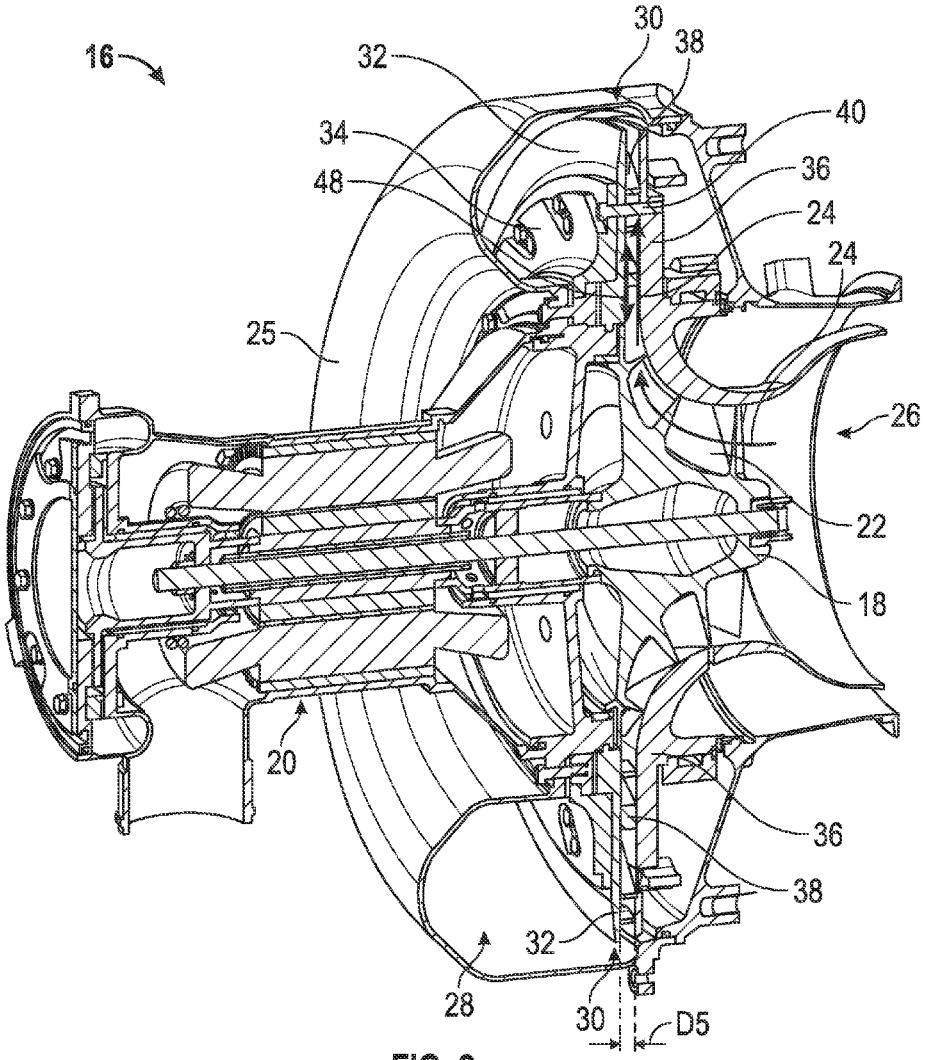
FIG. 2 is a cross-sectional view of an air compressor of the environmental control system of FIG. 1.

The air compressor 16 is shown in more detail in FIG. 2. The compressor 16 includes a rotor or impeller 18 that is driven by a motor 20. The impeller 18 includes one or more blades 22 for directing a flow of air through the compressor 16 while the impeller 18 is rotated by the motor 20. The flow of air is generally represented by arrows in FIG. 2 designated with the numeral 24. It is noted that the arrows 24 are only indicated on one half of the compressor 16 for better clarity of the components of the compressor 16, but that the flow of air occurs as indicated about the entire circumference of the impeller 18.

The impeller 18 and the motor 20 are contained within a housing 25, which may be constructed from multiple housing portions secured to one another. The housing 25 has an inlet 26 for providing air to the compressor 16. Air drawn through the inlet 26 is pumped radially outwardly to an outlet 28 by the blades 22, as indicated by the arrows 24. Before reaching the outlet 28, the air is passed through a diffuser assembly 30, as also indicated.

The diffuser assembly 30 includes a backing plate 32 supported by the housing 25, e.g., via a mounting plate 34. A shroud 36 is supported by the housing 25 on the side of the backing plate 32 opposite to the mounting plate 34. The flow of air as indicated by the arrows 24 is directed by the impeller 18 through the space between the backing plate 32 and the shroud 36. A plurality of vanes 38 are retained in this space between the backing plate 32 and the shroud 36 in order to impede the flow of air as it passes through the compressor 16. The vanes 38 can be arranged to exhibit some degree of movement relative to the backing plate 32 in order to vary a flow area through the diffuser assembly 30. In the illustrated embodiment, the vanes 38 are arranged to oscillate or pivot about a set of pins, bolts, or fasteners 40, e.g., between an open position in which the flow of air is relatively unimpeded and a partial open position in which the flow of air is relatively impeded and slowed. The fasteners 40 extend through the backing plate 32 between the mounting plate 34 and the shroud 36.

Figure 3:
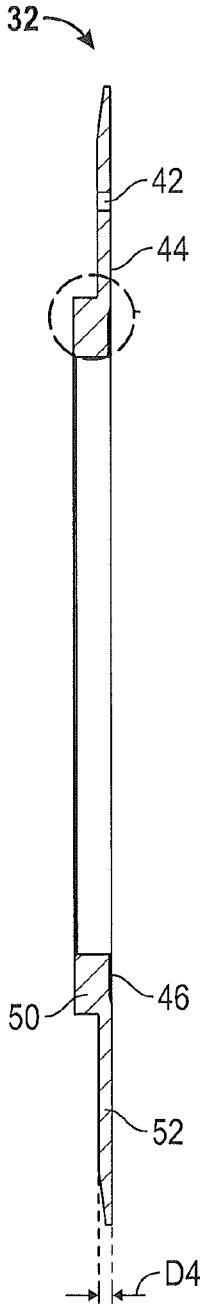
FIG. 3 is a cross-sectional view of a backing plate of the air compressor of FIG. 2.
Figure 4:
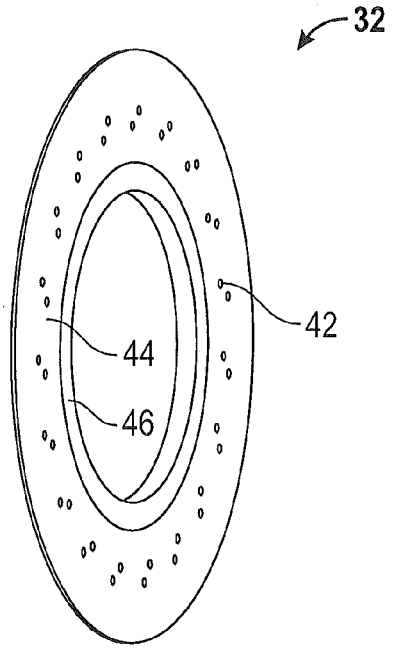
FIG. 4 is a perspective view of a surface of the backing plate of FIG. 3 having a relief feature formed therein.
Figure 5:
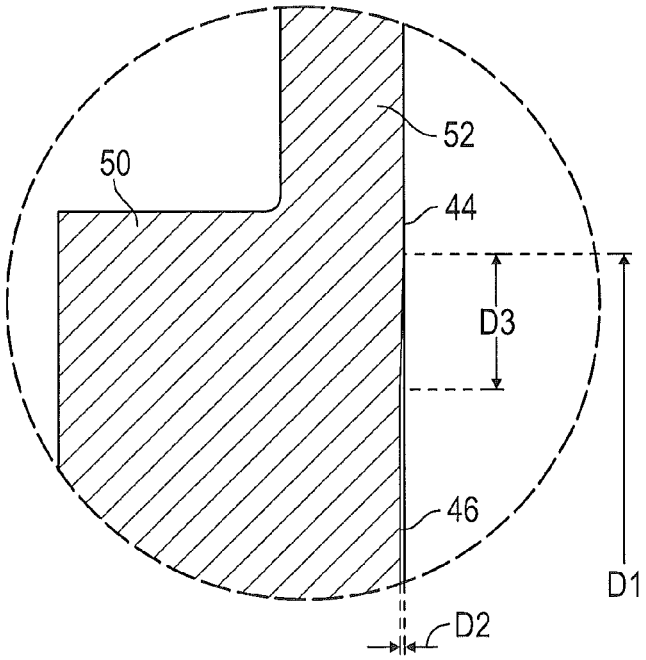
FIG. 5 is an enlarged view of the area of the backing plate encircled in FIG. 3.

The backing plate 32 is shown in without the other components of the air compressor 16 in FIGS. 3-5. The backing plate 32 includes bores or openings 42, for receiving corresponding ones of the fasteners 40. A surface 44 of the backing plate 32 is adjacent to the vanes 38 and at least partially defines the flow path taken by the flow of air through the diffuser assembly 30. A relief feature 46 is provided in the surface 44 of the backing plate 32 that enables a portion of the air in the diffuser assembly 30 to bypass the vanes 38. The bypass provided by the relief feature 46 is generally represented by an arrow designated with the numeral 48 in FIG. 2. Similar to the arrows 24, only one of the arrows 48 is illustrated for clarity, but it is to be appreciated that the bypass of air will be provided by the relief feature 46 for each of the vanes 38. It has been found that the bypass of air provided by the relief feature 46 advantageously improves operation of the compressor 16. For example, one benefit obtainable by use of the relief feature 46 in the surface 44 of the backing plate 32 is an increase in the surge margin of the compressor 16 under some operating conditions of the compressor 16. Improved surge margin translates to a corresponding increase in the overall operating range of the compressor 16, which may improve the lifespan, efficiency, and/or effectiveness of the compressor 16 while maintaining a desired pressure within a chamber of the aircraft 10, such as the cabin 12.

The relief feature 46 is created in one embodiment by machining or cutting a groove or recess into the surface 44 of the backing plate 32. In one embodiment, the backing plate 32 is formed with the relief feature 46, e.g., via a die or mold. The backing plate 32 includes a hub portion 50 and a flange portion 52, which may similarly be formed via machining, or via a die or mold, or some other manufacturing process before, during, or after creation of the relief feature 46. The backing plate 32 in embodiments other than that illustrated may also be formed of an essentially constant thickness, e.g., not having both the hub portion 50 and the flange portion 52, or take some other size or shape than that shown.

It is noted that the amount of air bypassing the vanes 38 via the relief feature 46 can be relatively small in comparison to the total volumetric flow of air passing through the diffuser assembly 30 and still advantageously improve the performance of the compressor 16 as noted above. For example, a set of dimensions for the relief feature 46 according to one embodiment can be appreciated in view of FIG. 5. In the embodiment of FIG. 5, a diameter D1 defines the radial bounds of the relief feature 46 with respect to the axis or center of the backing plate 32, while a dimension D2 denotes the axial depth of the relief feature 46, i.e., the amount that the relief feature 46 is recessed into the surface 44. The relief feature 46 may be abruptly formed in the surface 44 or gradually transition via a ramp or chamfer, as indicated along a distance D3.

In one embodiment, the depth D2 is between about 0.5% and 5% of a thickness D4 of the flange portion 52 of the backing plate 32, and more particularly, about 1.5% to 2.5% of the thickness D4. This corresponds to about 0.5% to 2.5%, or more particularly about 0.75% to 1.5%, of a width D5 of the flow path through the diffuser assembly 30 as shown in FIG. 2 and measured axially between the surface 44 of the backing plate 32 and the shroud 36. In one specific embodiment, the depth D2 is about 0.004 inches (approximately 0.10 mm), the thickness D4 is about 0.2 inches (approximately 5.08 mm), and the width D5 is between about 0.3 inches (approximately 7.62 mm) and 0.5 inches (approximately 12.7 mm). It is also noted that in the illustrated embodiment, the relief feature 46 is formed entirely within the radial extents of the hub portion 50, but in other embodiments the dimension D1 of the relief feature 46 can be enlarged to extend radially into the flange portion 52.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A compressor for pressurizing a flow of air within an aircraft, comprising:

an inlet providing the flow of air to the compressor;

an outlet providing the flow of air, after pressurization by the compressor, to a chamber of the aircraft; and a diffuser assembly disposed between the inlet and the outlet, the diffuser assembly including:

one or more vanes at least partially impeding the flow of air through the diffuser assembly; and a backing plate having a surface adjacent to the one or more vanes, the surface including a relief feature that enables air to bypass the one or more vanes, wherein the relief feature has an axial depth of about 0.5% to 2.5% of a width of a flow path through the diffuser assembly.

2. The compressor of claim 1, wherein the chamber is a cabin of the aircraft and the compressor is a cabin air compressor.

3. The compressor of claim 1, wherein the one or more vanes are pivotably mounted with respect to the backing plate.

4. The compressor of claim 1, wherein the relief feature is formed as a cut in the surface of the backing plate.

5. The compressor of claim 1, wherein the relief feature is formed as a recess in the surface of the backing plate.

6. The compressor of claim 1, wherein the relief feature has an axial depth of about 0.5% to 5% of a thickness of a flange of the backing plate.

7. The compressor of claim 6, wherein the axial depth is about 1.5% to 2.5% of the thickness of the flange.

8. The compressor of claim 1, further comprising an impeller for directing the flow of air from the inlet to the outlet through the diffuser assembly.

9. The compressor of claim 8, further comprising a motor for rotating the impeller.

10. An environmental control system for an aircraft including a compressor according to claim 1.

11. A compressor for pressurizing a flow of air within an aircraft, comprising:

an inlet providing the flow of air to the compressor;

an outlet providing the flow of air, after pressurization by the compressor, to a chamber of the aircraft; and a diffuser assembly disposed between the inlet and the outlet, the diffuser assembly including:

one or more vanes at least partially impeding the flow of air through the diffuser assembly; and a backing plate having a surface adjacent to the one or more vanes, the surface including a relief feature that enables air to bypass the one or more vanes, wherein the relief feature has an axial depth of about 0.5% to 5% of a thickness of a flange of the backing plate.

* * * * *